US010701772B2

(12) United States Patent
Schmidt

(10) Patent No.: US 10,701,772 B2
(45) Date of Patent: Jun. 30, 2020

(54) LIGHTING DEVICE WITH VARIABLE LIGHT DISTRIBUTION

(71) Applicant: LEDVANCE GmbH, Garching bei München (DE)

(72) Inventor: Hans-Joachim Schmidt, Ingolstadt (DE)

(73) Assignee: LEDVANCE GMBH, Garching bei München (DE)

( * ) Notice: Subject to any disclaimer, the term of this patent is extended or adjusted under 35 U.S.C. 154(b) by 0 days.

(21) Appl. No.: 15/787,891

(22) Filed: Oct. 19, 2017

(65) Prior Publication Data

US 2018/0116023 A1 Apr. 26, 2018

(30) Foreign Application Priority Data

Oct. 24, 2016 (DE) ..... 10 2016 120 256

(51) Int. Cl.

| | |
|---|---|
| ***F21V 1/00*** | (2006.01) |
| ***F21V 11/00*** | (2015.01) |
| ***H05B 45/10*** | (2020.01) |
| ***H05B 47/19*** | (2020.01) |
| ***F21V 5/02*** | (2006.01) |
| ***F21V 5/04*** | (2006.01) |
| ***F21V 23/04*** | (2006.01) |
| *F21K 9/233* | (2016.01) |
| *F21Y 105/18* | (2016.01) |
| *F21V 14/00* | (2018.01) |
| *F21Y 113/00* | (2016.01) |
| *F21Y 115/10* | (2016.01) |
| *F21K 9/232* | (2016.01) |
| *F21V 5/00* | (2018.01) |
| *F21V 3/00* | (2015.01) |

(52) U.S. Cl.

CPC ..... *H05B 45/10* (2020.01); *F21V 5/02* (2013.01); *F21V 5/04* (2013.01); *F21V 23/04* (2013.01); *H05B 47/19* (2020.01); *F21K 9/232* (2016.08); *F21K 9/233* (2016.08); *F21V 3/00* (2013.01); *F21V 5/005* (2013.01); *F21V 5/007* (2013.01); *F21V 5/045* (2013.01); *F21V 14/00* (2013.01); *F21V 23/0435* (2013.01); *F21Y 2105/18* (2016.08); *F21Y 2113/00* (2013.01); *F21Y 2115/10* (2016.08)

(58) Field of Classification Search

USPC ..... 362/236

See application file for complete search history.

(56) References Cited

U.S. PATENT DOCUMENTS

2001/0050892 A1* 12/2001 Takahashi ..... G11B 7/123 369/112.1
2005/0243432 A1* 11/2005 Takahashi ..... G01V 8/14 359/634
2008/0252939 A1* 10/2008 Kato ..... G02F 1/1362 358/472

(Continued)

*Primary Examiner* — Tuyen K Vo
(74) *Attorney, Agent, or Firm* — Hayes Soloway

(57) ABSTRACT

A lighting device comprises at least two groups of light-emitting diodes and an electronic circuit for controlling said light-emitting diodes. The electronic circuit is configured to control each group of light-emitting diodes separately. The beam characteristic of at least one of the groups of light-emitting diodes differs from the beam characteristic of at least one of the other groups of light-emitting diodes. As a result, the light distribution of the lighting device can be switched electronically.

19 Claims, 3 Drawing Sheets

(56) References Cited

U.S. PATENT DOCUMENTS

2008/0296555 A1* 12/2008 Miller ..... C09K 11/025 257/14
2010/0204841 A1* 8/2010 Chemel ..... H05B 33/0863 700/282
2011/0260616 A1* 10/2011 Chaterlea ..... B60Q 1/0041 315/82
2012/0327645 A1* 12/2012 You ..... F21S 9/04 362/192
2013/0065642 A1* 3/2013 Liu ..... G08C 17/02 455/557
2014/0098517 A1* 4/2014 Chen ..... F21S 48/1747 362/36
2014/0252987 A1* 9/2014 Hinrichs ..... H05B 33/0845 315/297
2014/0286044 A1* 9/2014 Johnson ..... G02B 5/021 362/607
2014/0301071 A1* 10/2014 Jorgensen ..... F21V 14/06 362/231
2014/0312780 A1* 10/2014 Vissenberg ..... G01B 11/14 315/153
2014/0340917 A1* 11/2014 Harraghy ..... B60Q 1/326 362/500
2014/0355264 A1* 12/2014 Chinniah ..... F21V 14/06 362/241
2016/0069540 A1* 3/2016 Kjeldsen ..... F21S 10/00 362/232
2016/0348872 A1* 12/2016 Sun ..... F21V 5/007
2016/0377252 A1* 12/2016 Bhakta ..... F21V 29/77 362/520
2017/0153383 A1* 6/2017 Lee ..... G02F 1/1323
2017/0238396 A1* 8/2017 Knibbe ..... H05B 37/0227 315/151
2017/0350579 A1* 12/2017 Kwak ..... F21V 5/04
2018/0106432 A1* 4/2018 Bergenek ..... F21V 7/05
2018/0187860 A1* 7/2018 Johnson ..... G02F 1/1323

* cited by examiner

LIGHTING DEVICE WITH VARIABLE LIGHT DISTRIBUTION

CROSS-REFERENCE TO RELATED APPLICATION AND PRIORITY

This patent application claims priority from German Patent Application No. 10 2016 120 256.8 filed on Oct. 24, 2016, which is herein incorporated by reference in its entirety.

TECHNICAL FIELD

The present invention relates to a lighting device with electronically controllable light distribution.

PRIOR ART

Known luminaires, in which the light distribution can be adjusted, use, for example, a mechanically adjustable reflector (e.g. flashlights) or an elaborate reflector arrangement with a plurality of light sources between which it is possible to switch (e.g. H4 lamps for car headlights). Such solutions are expensive to manufacture and/or conceal an increased risk of a defect.

SUMMARY OF THE INVENTION

Based on the known prior art, it is an object of the present invention to provide an improved lighting device with electronically controllable light distribution.

The object is achieved by a lighting device having the features of the independent claim. Advantageous developments emerge from the dependent claims.

A lighting device according to the invention comprises at least two groups of light-emitting diodes and an electronic circuit for controlling said light-emitting diodes. The light-emitting diodes of one group preferably do not differ from each other (apart from manufacturing tolerances). The electronic circuit is configured to control each group of light-emitting diodes separately. When controlling a group of light-emitting diodes, all the light-emitting diodes of the group are preferably supplied with the same electrical parameters (for example voltage or current). Thus all the light-emitting diodes of a group ideally produce identical illumination results (again apart from manufacturing tolerances). A group of light-emitting diodes may comprise one or more light-emitting diodes.

The individual groups of light-emitting diodes can differ from each other. In particular, the beam characteristic of at least one of the groups of light-emitting diodes differs from the beam characteristic of at least one of the other groups of light-emitting diodes. As a result, a different light distribution can be achieved depending on which of the groups of light-emitting diodes are controlled and thus emit light.

Such a lighting device makes it possible to select and change the light distribution and therefore also the desired lighting effect electronically. In particular, there is no need for elaborate mechanics or for a reflector enclosing a plurality of light sources.

The term "light-emitting diode" in this case is understood as both an individual light-emitting diode (LED) and also a plurality of light-emitting diodes combined in one LED module. In this case, an LED module can comprise a single set of electrical connections (e.g. two connections) via which all light-emitting diodes of the LED module can be supplied with electrical energy.

In an embodiment, the beam characteristics of the light-emitting diodes of the at least one of the groups of light-emitting diodes differs from the beam characteristics of the light-emitting diodes of the at least one of the other groups of light-emitting diodes. For example, one group of light-emitting diodes may consist of light-emitting diodes with first beam characteristics and another group of light-emitting diodes may consist of light-emitting diodes with second beam characteristics.

In an embodiment, the lighting device may further comprise at least one beam shaping element positioned downstream of at least one of the groups of light-emitting diodes. "Downstream" means that the light-emitted by the group of light-emitting diodes passes through the beam shaping element. In this embodiment, two groups of light-emitting diodes may consist of the same type of light-emitting diodes (i.e., the beam characteristics of the light-emitting diodes of both groups may be essentially the same) while different beam characteristics for both groups can be achieved by means of the beam shaping element.

In an embodiment, the lighting device may further comprise at least one first beam shaping element positioned downstream of at least one of the groups of light-emitting diodes and at least one second beam shaping element positioned downstream of at least one of the other groups of light emitting diodes. In this embodiment, two groups of light-emitting diodes may consist of the same type of light-emitting diodes (i.e., the beam characteristics of the light-emitting diodes of both groups may be essentially the same) while different beam characteristics for both groups can be achieved by means of two different beam shaping elements. Two or more beam shaping elements may be integrated into a single unit.

In an embodiment, the beam characteristics of one of the groups of light-emitting diodes differs from the beam characteristic of at least one of the other groups of light-emitting diodes downstream of the beam shaping elements.

As has been explained above, different beam characteristics may be achieved by using either light-emitting diodes having different beam characteristics or by using light-emitting diodes having essentially the same beam characteristics, but manipulating the beam characteristics of the groups of light-emitting diodes by means of beam shaping elements.

The present disclosure also provides that different groups of light-emitting diodes may each consist of light-emitting diodes with different beam characteristics and that beam shaping elements are additionally used to manipulate the beam characteristics of different groups of light-emitting diodes.

Where the following disclosure discusses the beam characteristics of the light-emitting diodes, the description can also be applied to the beam characteristics of a group of light-emitting diodes.

The beam characteristic in which the groups of light-emitting diodes differ can be the opening angle of the beam, the main direction of the beam, or a combination of the two. The opening angle of the beam of a light-emitting diode can be the full width at half maximum (FWHM) or the 1/e width of the light cone emitted by the light-emitting diode at a predetermined distance from said light-emitting diode. If the cross-section through the light cone perpendicular to the direction of emission is not circular, then of course, the full width at half maximum or 1/e width must always be determined in the same orientation of the light-emitting diode.

The light-emitting diodes of a first group (or the first group downstream of a first beam shaping element) preferably have a highly divergent beam, while the light-emitting diodes of a second group (or the second group downstream of a second beam shaping element) have a narrow beam. In this case, relative terms such as "divergent" or "narrow" always refer to the relationship between the corresponding parameters of different groups of light-emitting diodes. A group of light-emitting diodes with narrow beam thus has a beam that is narrower than the beam of a different group of light-emitting diodes. The opening angle of the light-emitting diodes can have full width at half maximum between approximately 10° and approximately 120°. For example, the light-emitting diodes of a first group can have an opening angle with a full width at half maximum between approximately 90° and approximately 110°, in particular approximately 100°, while the light-emitting diodes of a second group have an opening angle with a full width at half maximum between approximately 30° and approximately 50°, in particular approximately 40°. In this case, the light-emitting diodes of the first group are described as "divergent-emitting" and the light-emitting diodes of the second group as "narrow-emitting".

The main direction of the beam can be understood as the direction in which the intensity maximum of the light distribution is emitted. It can also be understood as a symmetry axis marked out by the light distribution. For example, a lighting device according to the invention can comprise a first group of light-emitting diodes which emit light in a first direction (e.g. downwards) as well as a second group of light-emitting diodes which emit light in a second direction which is different from the first direction (e.g. to the side or upwards).

A lighting device according to the invention can also combine a plurality of beam characteristics in which the groups of light-emitting diodes differ. In a lighting device, for example, the light-emitting diodes of a first group can emit light in a first direction with a divergent beam, the light-emitting diodes of a second group can emit light in the first direction with a narrow beam and the light-emitting diodes of a third group can emit light in a second direction with a divergent beam. A fourth group with light-emitting diodes which emit light in the second direction with a narrow beam can also be provided.

For each beam characteristic by which the light-emitting diodes from different groups vary, it is also possible to provide more than two different "values". Thus, for example, three or more groups of light-emitting diodes can be provided which emit light in a corresponding number of main directions. (The main direction of the beam is considered here as the "value" of the corresponding beam characteristic.) Three or more groups of light-emitting diodes can also be provided, each of which has a different opening angle of the beam. Combinations of these options are also provided.

In a preferred embodiment, the light-emitting diodes of each group are arranged spatially adjacent to each other. For example, the light-emitting diodes of a first group can be arranged in a first part of the lighting device and the light-emitting diodes of a second group in a second part. "First part" and "second part" here does not necessarily mean that this arrangement also involves different directions of the beam. A corresponding arrangement can be achieved, for example, in that the light-emitting diodes of the first group are arranged approximately in the middle of the lighting device, while the light-emitting diodes of the second group are arranged in a ring around the first group. Other possible distributions, for example, can be "left/right" or "front/back".

Alternatively, the light-emitting diodes of at least two groups can be arranged intermixed with each other. For example, with a linear arrangement of the light-emitting diodes, the light-emitting diodes of two groups can be arranged alternately. Even in a two-dimensional arrangement, a mixed arrangement can be provided, for example, in that individual light-emitting diodes of a first group are arranged within a plurality of light-emitting diodes of a second group.

A combination of the two arrangements described above is also possible. Thus, for example, the light-emitting diodes of two groups can be arranged intermixed with each other, while the light-emitting diodes of a third group are arranged separately therefrom and only adjacent to each other within the third group.

With a mixed arrangement of the light-emitting diodes of different groups, it is possible to ensure that the shape and size of the light emitting area on the lighting device does not change substantially when switching between the groups of light-emitting diodes. By contrast, with a separate arrangement of the light-emitting diodes, there can be a visible change in the shape and/or size of the light emitting area on the lighting device. Both effects can be used to achieve a desired overall effect of the lighting device.

In a preferred embodiment, the electronic circuit comprises a driver circuit for each group of light-emitting diodes. The driver circuit is configured to supply the light-emitting diodes of the relevant group with electrical energy, e.g. in the form of a constant current source or a constant voltage source, with the electrical parameters suitable for the light-emitting diodes. Preferably, each of these driver circuits can be connected to a corresponding switch (e.g. on-off switch or dimmer) outside the lighting device (for example, a wall switch). As a result, the individual groups of light-emitting diodes can be switched on and off and dimmed, if necessary, independently of each other via the switches.

The electronic circuit can also comprise a control module for controlling the driver circuit, i.e. the control module can determine which group of light-emitting diodes is switched on or off or to what extent a group of light-emitting diodes is dimmed. Preferably, the control module can be connected to one or more switches outside the lighting device (external switches). Here too, the operating state of the lighting device can be selected via the external switches. Unlike the embodiment described above, in which the individual driver circuits can each be connected to a corresponding switch, which switch, if required, must therefore operate mains voltage (230 V), in this case the switches only operate control signals.

In an embodiment, each time a single switch is set to "on", one of a predetermined combination of groups of light-emitting diodes may be switched on by the control module. For example, when the switch is set to "on" for the first time, a first group of light-emitting diodes may be switched on; when the switch is then set to "off" and to "on" again, the first group of light-emitting diodes may be switched off and a second group of light-emitting diodes may be switched on; when the switch is then set to "off" and to "on" again, both groups of light-emitting diodes may be switched on. This "sequential switching" behavior may be achieved with a standard switch in combination with the control module or with a "sequential" switch that connects multiple output terminals to a single input terminal depending on the number of actuations.

In a preferred embodiment, the electronic circuit further comprises a communication module which is configured for communication with an operating unit outside the lighting device. Control module and communication module can also be combined in a common electronic circuit.

The communication between communication module and operating unit can be wired and/or wireless. The operating unit can be used to select the operating state of the lighting device which is then transmitted via the communication module to the control module which correspondingly controls the driver circuits. Wireless communication between operating unit and communication module has the advantage that a cable is only required for the power supply of the lighting device and not for the control. This is particularly advantageous when retrofitting existing electrical installations with a lighting device according to the invention. The lighting device according to the invention is basically suitable for all types of power supply. If necessary, a suitable adapter can be used to adjust the electrical parameters.

The operating unit can be permanently installed in the room but it can also be designed to be portable. It is further provided that the operating unit is a computer, in particular a tablet computer or a smartphone on which a software module (program or app) is run.

In an embodiment, the lighting device comprises a single driver circuit which is adapted to drive one of multiple groups of light-emitting diodes. Preferably, the multiple groups of light-emitting diodes require the same electrical operating parameters. Switching between the groups of light-emitting diodes may be achieved with one of the procedures described above, in particular with "sequential switching." This embodiment is particularly advantageous in situations where, due to spatial or thermal restrictions, only a single driver circuit may be installed. This may be the case for retrofit lighting devices which are supposed to replace existing lighting devices with predetermined maximum dimensions.

The invention further relates to a lighting system comprising one or more lighting devices illustrated above. The lighting system preferably also has an operating unit (e.g. as discussed above) for selectively controlling the groups of light-emitting diodes of the lighting devices.

The term "lighting device" is understood here to mean luminaires and lamps, that is in particular workplace luminaires, spotlights and retrofit lamps for replacing conventional filament bulbs. The term "lighting device" also includes devices for the generation of optical radiation outside the visible range, that is from the ultraviolet (UV) range up to the near-infrared (NIR) range, for example lamps that are intended for the illumination of plants. A lighting device according to the invention for plants, for example, could be adjusted in the emission angle (automatically if necessary) to the growth of the plant.

BRIEF DESCRIPTION OF THE FIGURES

Preferred further embodiments of the invention will be explained in greater detail using the following description of the figures. It is shown in.

DETAILED DESCRIPTION OF THE INVENTION

Preferred embodiments will be described below based on the figures. In this case, identical, similar or equivalent elements are provided with the same reference numbers in the different figures and repeated description of these elements is partly omitted to avoid redundancies.

In FIGS. 1-3 described below, the arrangement of light-emitting diodes on a substrate (e.g. a circuit board) is shown. Other components of the lighting devices, e.g. housing, electronic control circuit, etc. are not shown.

The luminous intensity distribution curves and brightness distributions shown in FIGS. 2-3 are of a purely qualitative type and highly simplified for better understanding.

Figure 1A:
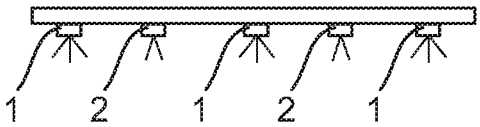
FIG. 1*a* a schematic representation of a first embodiment of a lighting device according to the invention.
Figure 1B:
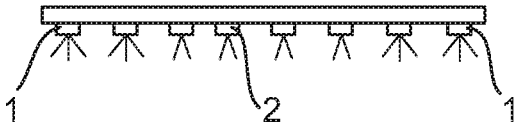
FIG. 1*b* a schematic representation of a second embodiment of a lighting device according to the invention.

FIG. 1*a* and FIG. 1*b* show schematically two embodiments of a lighting device according to the invention. In the illustration according to FIG. 1*a*, light-emitting diodes 1 with a large opening angle (divergent beam) and light-emitting diodes 2 with a small opening angle (narrow beam) are arranged alternately in a row on a substrate 3. Here and in the following, the opening angle is illustrated schematically by the rays emanating from the light-emitting diode. The light-emitting diodes 1 with large opening angle form a first group of light-emitting diodes 1, the light-emitting diodes 2 with small opening angle form a second group of light-emitting diodes 2. The light-emitting diodes 1 of the first group can be switched on and off and dimmed, if necessary, together. The light-emitting diodes 2 of the second group can also be switched on and off and dimmed, if necessary, together. Due to the mixed arrangement of the light-emitting diodes 1,2 of the two groups, the shape and size of the light emitting area on the lighting device are largely independent of the operating state, i.e. independent of whether only the light-emitting diodes 1 of the first group, only the light-emitting diodes 2 of the second group, or the light-emitting diodes 1,2 of both groups are switched on. This applies in particular, the more light-emitting diodes are used in both groups.

In the illustration according to FIG. 1*b*, the light-emitting diodes 2 with small opening angle are arranged adjacent to each other in the center of the lighting device as a first group of light-emitting diodes 2. The light-emitting diodes 2 of the first group can be switched on and off and dimmed, if necessary, together. The light-emitting diodes 1 with large opening angle are arranged on either side of this first group, in each case a plurality of light-emitting diodes 1 adjacent to each other as subgroups. Even if the two subgroups are separate from each other, the light-emitting diodes 1 of both subgroups can nevertheless be switched on and off and dimmed, if necessary, together as a second group. Alternatively, it can be provided that both subgroups represent separate groups which can be controlled separately from each other. The separation of a group into subgroups can also be used in other embodiments.

Figure 2A:
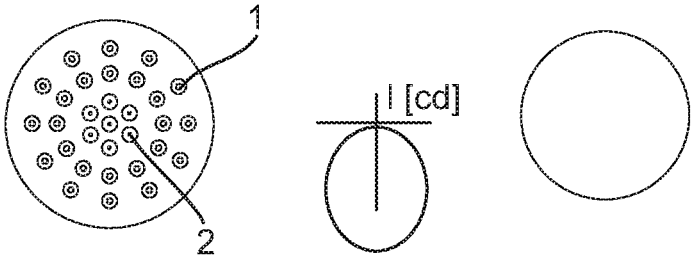
FIG. 2*a-c* schematic representations of various operating states of a further embodiment of a lighting device according to the invention.
Figure 2B:
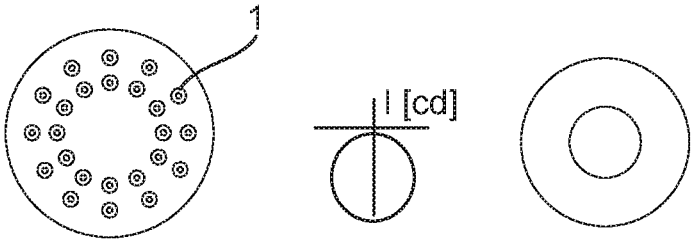
Figure 2C:
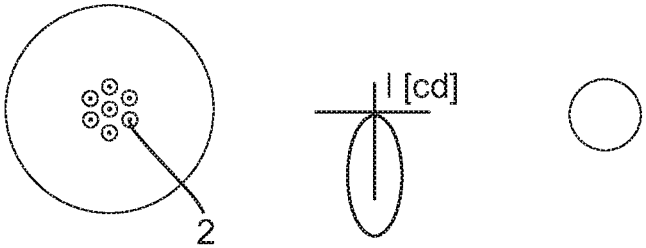

FIGS. 2*a*-2*c* show schematically on the left various operating states of a further embodiment of a lighting device according to the invention and in each case the associated luminous intensity distribution (center) and the shape of the light emitting area (right). In the operating states shown on the left, in each case only the light-emitting diodes which are switched on are shown. Switched off light-emitting diodes are not reproduced in this illustration, although they are, of course, present.

In this embodiment, the light-emitting diodes 2 with small opening angle are arranged adjacent to each other in the center of the lighting device as a first group. The light-emitting diodes 1 with large opening angle, as the second group, surround the first group of light-emitting diodes substantially in a ring shape. The light-emitting diodes 2 with small opening angle are shown schematically as a circle with a central dot, the light-emitting diodes 1 with large opening angle are shown schematically as a circle with a concentric small circle therein.

In FIG. 2*b*, only the outer light-emitting diodes 1 with large opening angle of the second group are switched on. This results in wide divergent luminous intensity distribution. The light emitting area of the lighting device shows a gap in the middle where the switched off light-emitting diodes 2 of the first group are situated and as a result has the shape of a donut.

In FIG. 2*c*, only the inner light-emitting diodes 2 with small opening angle of the first group are switched on. This results in narrow luminous intensity distribution. The light emission from the lighting device only takes place in a small region in the center and has the shape of a small circular disk.

In FIG. 2*a*, the light-emitting diodes 1,2 of both groups are switched on. The luminous intensity distribution therefore corresponds to the combination of the two cases described above, i.e. a broad divergent light distribution with an additional portion directed towards the "front", i.e. along the main direction of emission. The light emission from the lighting device takes place across the entire light emitting area and as a result has the shape of a large circular disk.

Figure 3A:
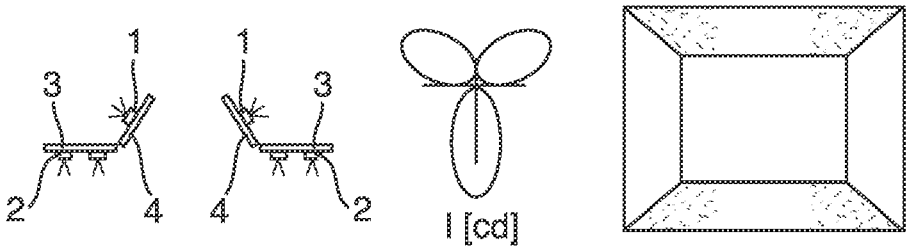
FIG. 3*a-c* schematic representations of various operational states of a further embodiment of a lighting device according to the invention.
Figure 3B:
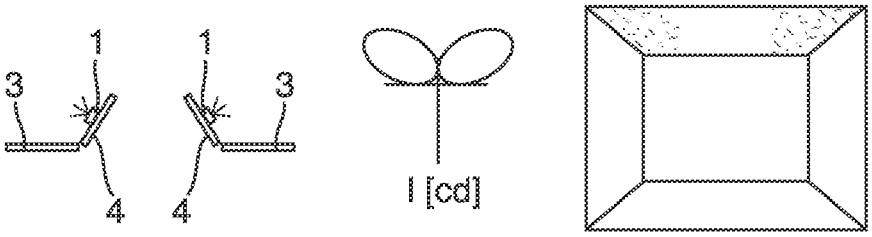
Figure 3C:
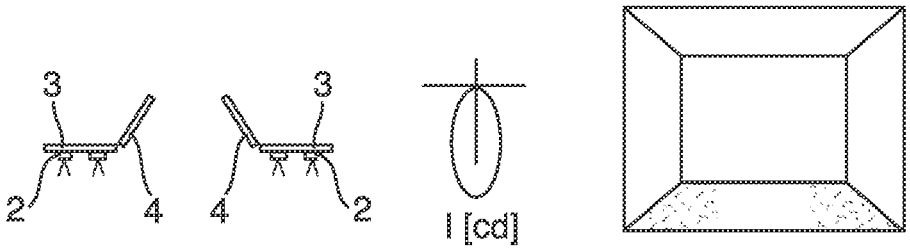

In FIGS. 3*a*-3*c*, schematic representations of various operating states of a further embodiment of a lighting device according to the invention are shown schematically on the left. The luminous intensity distribution is again shown schematically in the center, shown on the right is schematically the lighting effect in a room when the third embodiment is suspended from the ceiling in the room.

The illustration of the operating states on the left shows in each case only a section through the lighting device. The lighting device can be designed as linear, round or as a polygon, even adapted to the shape of the room. The lighting device comprises a first substrate 3 substantially parallel to the room ceiling and a second substrate 4 arranged at an angle to substrate 3. On the first substrate 3, light-emitting diodes 2 with small opening angle are arranged as the first group in such a way that they emit light substantially downwards and thus produce direct lighting. On the second substrate 4, light-emitting diodes 1 with large opening angle are arranged as a second group in such a way that they emit light obliquely upwards and thus against the room ceiling, thus producing indirect lighting.

FIG. 3*b* shows the operating state in which only the light-emitting diodes 1 of the second group are switched on (only indirect illumination by lighting up the ceiling). FIG. 3*c* shows the operating state in which only the light-emitting diodes 2 of the first group are switched on (only direct lighting). FIG. 3*a* shows the operating state in which the light-emitting diodes 1,2 of both groups are switched on. In the illustration of the lighting effect on the right, the directly lit region of the room is shown hatched in each case (assuming that two corresponding linear lighting devices extend from front to back in the schematically illustrated room, each with an illumination direction of the second group towards the respective wall, as shown in the left-hand column).

If the lighting devices described above are configured to be dimmable, then not only is it possible to adjust the described operating states but also mixed states; in FIG. 2, for example, highly narrow lighting using the light-emitting diodes 2 of the first group with simultaneously weak lighting due to the widely divergent light-emitting diodes 1 of the second group. In FIG. 3, for example, strong direct lighting can be combined with weak indirect lighting. Other combinations are also possible.

Figure 4:
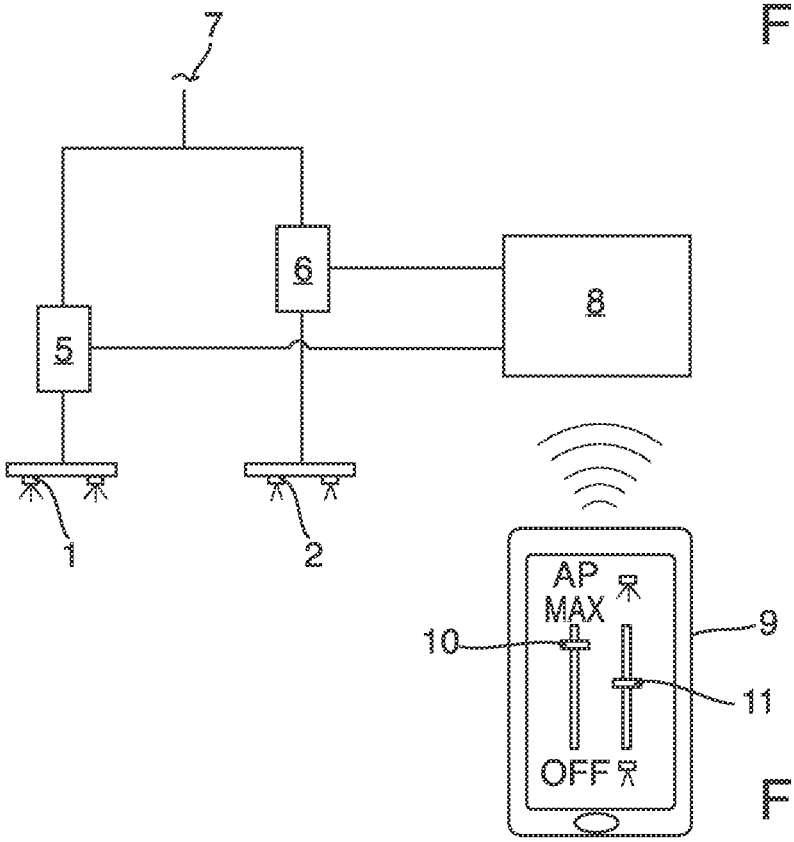
FIG. 4 a schematic representation of an embodiment of the electronic control of a lighting device according to the invention.

FIG. 4 shows a schematic representation of an embodiment of the electronic control of a lighting device according to the invention. The lighting device comprises a first group of light-emitting diodes 1 (here with large opening angle) and a second group of light-emitting diodes 2 (here with small opening angle). For the sake of simplicity, the light-emitting diodes 1,2 of the two groups are shown here separate from each other since in this case only the connections of the electrical control are important. The groups can, however, be arranged intermixed with each other. The light-emitting diodes 1 of the first group are controlled by a first driver 5, the light-emitting diodes 2 of the second group are controlled by a second driver 6. Both drivers 5,6 are connected to the mains voltage 7 (e.g. 230 V alternating voltage) and generate therefrom the voltages or currents required for the light-emitting diodes 1,2.

Both drivers 5,6 are controlled by a communication and control module 8. The communication and control module 8 controls the drivers 5,6 in such a manner that the operating state of the lighting device selected on an operating unit 9 is achieved. The information about the selected operating state is transmitted via radio from the operating unit 9 to the communication and control module 8. The operating unit 9 can be a radio remote control provided for the lighting device or a smartphone with a corresponding app. The radio communication can take place via a known radio standard such as Bluetooth, ZigBee or similar, or via a radio protocol specially created for the lighting device.

In the embodiment shown, the operating unit 9 has two control elements: the overall output of the lighting device is selected via the left-hand slide control 10. The distribution of the overall output across the two groups of light-emitting diodes 1,2 is selected using the right-hand slide control 11. In its central position, the overall output is distributed evenly across both groups of light-emitting diodes 1,2. In the upper position, the second group with the narrow-emitting light-emitting diodes 2 is switched off and the first group with the wide divergent light-emitting diodes 1 is supplied. This is reversed in the lower position. The right hand slide control 11 thus enables crossfading between the two groups. As a result, the perception of a room lit in this manner can be varied from diffuse and low-shadow through to dramatic scenery in the manner of stage lighting.

The two slide controls 10,11 can be configured as mechanical slide controls or as a corresponding display on a touchscreen. Other suitable components, e.g. rocker switches, rotary knobs, etc. can also be used instead of slide controls 10,11.

Figure 5:
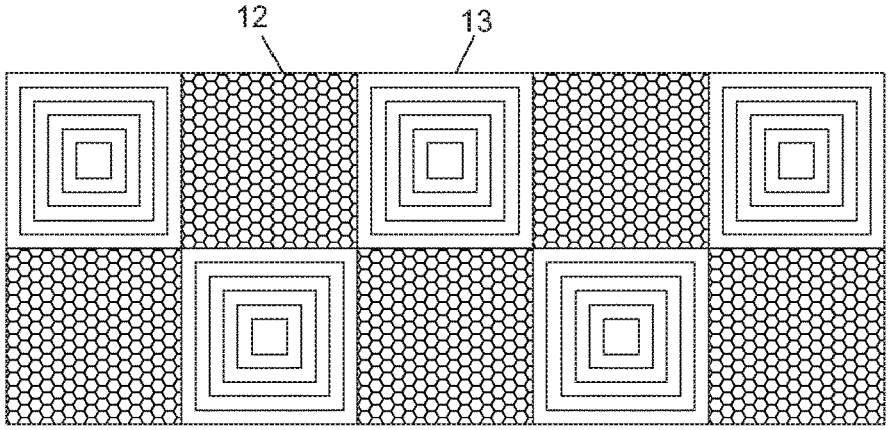
FIG. 5 a schematic representation of a further embodiment of a lighting device according to the invention.

FIG. 5 shows schematically a further embodiment of a lighting device according to the invention. The lighting device comprises ten groups of light-emitting diodes (not shown) that are arranged in two rows with five groups in each row. Different numbers and arrangements of the groups may also be possible. The light-emitting diodes of all groups may have essentially the same beam characteristics. Downstream of each group of light-emitting diodes a beam shaping element 12,13 is arranged. The lighting device comprises two types of beam shaping elements that may be arranged alternately, for example in a checkerboard pattern. The first beam shaping elements 12 may comprise diffusely transmitting areas, for example matted, frosted, or structured, such that light from the light-emitting diodes passing the first beam shaping elements is diffusely scattered in order to achieve soft illumination of a wide space. The second beam shaping elements 13 may comprise focusing areas, for example with lenses, Fresnel lenses, prisms, etc., focusing light from the light-emitting diodes passing the second beam shaping elements in order to achieve direct illumination of a smaller area.

FIG. 5 shows the beam shaping elements 12,13 having a square shape and abutting each other. The beam shaping elements 12,13 may be separate components or they may be integrated into a single element, acting, for example, as translucent cover for the lighting device. In other embodiments, the beam shaping elements may be separated from each other, for example by a frame or by housing portions. In still other embodiments, the shape of the beam shaping elements may by rectangular, polygonal, circular, etc. All beam shaping elements may have the same shape or the beam shaping elements may have different shapes.

Figure 6:
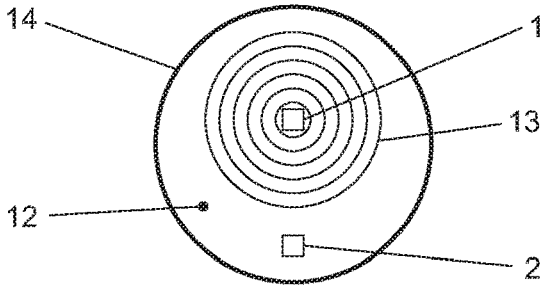
FIG. 6 a schematic representation of a further embodiment of a lighting device according to the invention.

FIG. 6 shows schematically a further embodiment of a lighting device according to the invention. The lighting device comprises two groups of light-emitting diodes 1,2. The light-emitting diodes of each group are located next to each other, for example as an LED module. The two groups are separated from each other and are installed into a common housing. The two groups may be installed on a common carrier, for example a common printed circuit board. The housing is provided with a transparent cover 14 having a first area acting as first beam shaping element 12 and a second area acting as second beam shaping element 13. The second beam shaping element 13 comprises an array of lenses and prisms and serves to focus light coming from the first light-emitting diodes 1. Such an array of lenses and prisms is for example used in OSRAM PARATHOM PAR16 LED lamps. The remaining area of the transparent cover 14 (or only portions thereof) acts as first beam shaping element 12 and may be transparent, matted, or otherwise achieving a diffuse scattering of light coming from the second group of light-emitting diodes 2.

The groups of light-emitting diodes 1,2 are held in place inside the housing by one or more holding structures (not shown). Preferably, the holding structure holding the lower group of light-emitting diodes is designed to be thin, so as to obstruct the light coming from the upper group of light-emitting diodes as little as possible.

The opening angle (FWHM) of the beam coming from the first group of light-emitting diodes (first LED module) may be more narrow than the opening angle (FWHM) of the beam coming from the second group of light-emitting diodes (second LED module). The opening angle of the beam of the first LED module may be approximately 36°. The opening angle of the beam of the second LED module may be approximately 120°.

Operating only the first group of light-emitting diodes results in a focused illumination, operating only the second group of light-emitting diodes results in a broad illumination, and operating both groups of light-emitting diodes results is a broad illumination with increased illumination in the middle region.

FIG. 6 shows the housing to have a circular cross section. The housing may have the shape of known lamps such as type MR11, MR16, AR111, R50, R63, R80, PAR16, PAR20, PAR30, and PAR38, each with different bases. Such lighting devices may be used as retrofit lamps in existing installations. Other types and shapes of housings may also be used.

Figure 7:
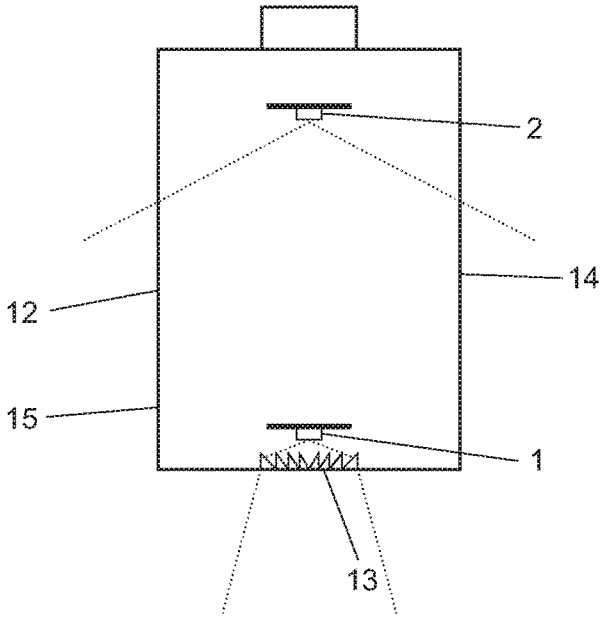
FIG. 7 a schematic representation of a further embodiment of a lighting device according to the invention.

FIG. 7 shows schematically a further embodiment of a lighting device according to the invention in cross-section. The embodiment shown here essentially corresponds to the embodiment of FIG. 6, but the two groups of light-emitting diodes 1,2 are installed one behind the other. The first group of light-emitting diodes 1 is installed next to an area of the transparent housing including an array of lenses and prisms and acting as second beam shaping element 13. The remainder of the transparent cover 14, in particular the side walls 15 thereof, (or only portions thereof) acts as first beam shaping element 12 and may be transparent, matted, or otherwise achieving a diffuse scattering of light coming from the second group of light-emitting diodes 2.

The opening angles of the LED modules are schematically indicated by dotted lines in FIG. 7.

FIG. 7 shows the housing and in particular the transparent cover 14 to have a cylindrical shape. Other types and shapes of housings may also be used, such as bulb shapes known from traditional incandescent lamps. Such lighting devices may be used as retrofit lamps in existing installations. Although the invention has been illustrated and described in greater detail using the embodiments shown, the invention is not limited thereto and a person skilled in the art may derive other variations therefrom without departing from the scope of protection of the invention. For example, light-emitting diodes of different groups may, in addition to different beam characteristics as explained above, have different colors or color temperatures.

Generally, "one" may be understood to mean a single figure or a plurality, particularly in the sense of "at least one" or "one or more", etc., as long as this is not explicitly excluded, e.g. by the expression "exactly one".

A specified figure may also include exactly the number and also a customary tolerance range, as long as this is not explicitly excluded.

Where applicable, all the individual features illustrated in the embodiments can be combined and/or replaced with each other without departing from the scope of the invention.

LIST OF REFERENCE NUMBERS

1 Light-emitting diode
2 Light-emitting diode
3 Substrate
4 Substrate
5 Driver
6 Driver
7 Mains voltage
8 Communication and control module
9 Operating unit
10 Controller
11 Controller
12 Beam shaping element
13 Beam shaping element
14 Transparent cover
15 Side walls

The invention claimed is:

1. A lighting device having an electronically adjustable light distribution, the lighting device comprising:
   a first group of light-emitting diodes characterized as having a first beam opening angle;
   a second group of light-emitting diodes characterized as having a second beam opening angle; and
   an electronic circuit for electronically controlling said first and second groups of light-emitting diodes separately, the electronic circuit comprising:
      a first driver circuit configured to drive the first group of light-emitting diodes; and
      a second driver circuit configured to drive the second group of light-emitting diodes;
   wherein the first beam opening angle is of a greater full width at half maximum (FWHM) than the second beam opening angle, wherein:
      the FWHM of the first beam opening angle is between about 90-110°; and
      the FWHM of the second beam opening angle is between about 30-50°.

2. The lighting device according to claim 1, further comprising at least one beam shaping element positioned downstream of at least one of the first and second groups of light-emitting diodes.

3. The lighting device according to claim 1, further comprising:
   at least one first beam shaping element positioned downstream of at least one of the first and second groups of light-emitting diodes; and
   at least one second beam shaping element positioned downstream of at least one of the first and second groups of light-emitting diodes.

4. The lighting device according to claim 3, wherein the at least one first beam shaping element and the at least one second beam shaping element are separate components.

5. The lighting device according to claim 3, wherein the at least one first beam shaping element and the at least one second beam shaping element are integrated into a single component.

6. The lighting device according to claim 3, wherein:
   one of either the at least one first beam shaping element or the at least one second beam shaping element is diffusely scattering; and
   the other of either the at least one first beam shaping element or the at least one second beam shaping element is focusing.

7. The lighting device according to claim 1, wherein the light-emitting diodes of each of the first and second groups are arranged spatially adjacent to each other.

8. The lighting device according to claim 1, wherein the light-emitting diodes of the first and second groups are arranged so as to be intermixed with each other.

9. The lighting device according to claim 1, wherein each of the first and second driver circuits is configured to be connected to a switch outside said lighting device.

10. The lighting device according to claim 1, wherein the electronic circuit further comprises a control module for controlling the first and second driver circuits, wherein the control module is configured to be connected to one or more switches outside said lighting device.

11. The lighting device according to claim 10, wherein the electronic circuit further comprises a communication module configured for at least one of wired and wireless communication with an operating unit outside said lighting device.

12. The lighting device according to claim 11, wherein in being configured for communication with the operating unit, the communication module is configured to receive at least one control signal from the operating unit, in response to which at least one of:
   an overall output of the lighting device is changed; and
   a distribution of an overall output across the first and second groups of light-emitting diodes is changed.

13. A lighting system comprising one or a plurality of lighting devices according to claim 1.

14. The lighting system according to claim 13, further comprising an operating unit for selectively controlling the first and second groups of light-emitting diodes of the lighting devices.

15. The lighting system according to claim 14, wherein the operating unit comprises a software module for running on at least one of a computer and a smartphone.

16. The lighting device according to claim 1, wherein the first and second groups of light-emitting diodes also differ in at least one of:
   beam main direction;
   color; and
   color temperature.

17. The lighting device according to claim 1, wherein:
   the FWHM of the first beam opening angle is about 100°; and
   the FWHM of the second beam opening angle is about 40°.

18. The lighting device according to claim 1, wherein the first and second groups of light-emitting diodes share a common substrate.

19. The lighting device according to claim 1, wherein the first group of light-emitting diodes is arranged concentrically about the second group of light-emitting diodes.

* * * * *